United States Patent [19]

Abrams

[11] Patent Number: 4,830,540

[45] Date of Patent: May 16, 1989

[54] METHOD FOR CONSTRUCTING INSPECTABLE WELDED JOINTS WHICH ARE RESISTANT TO MARINE BIOFOULING, AND WELDED JOINTS FORMED THEREBY

[75] Inventor: Philip I. Abrams, Houston, Tex.

[73] Assignee: Exxon Production Research Company, Houston, Tex.

[21] Appl. No.: 12,531

[22] Filed: Feb. 9, 1987

[51] Int. Cl.[4] ..... E02B 17/00

[52] U.S. Cl. ..... 405/216; 405/195

[58] Field of Search ..... 405/195, 211, 216; 204/146, 147, 196, 197

[56] References Cited

U.S. PATENT DOCUMENTS

| | | | |
|---|---|---|---|
| 2,294,897 | 9/1942 | Ellis | 73/762 |
| 2,824,481 | 2/1958 | Johnson | 411/8 |
| 3,426,473 | 2/1969 | Cardarelli | 405/211 X |
| 3,563,940 | 2/1971 | Borucki | 524/143 |
| 3,803,485 | 4/1974 | Crites et al. | 324/65 R |
| 3,979,949 | 9/1976 | Smith | 73/787 |
| 4,143,540 | 3/1979 | Peterson et al. | 405/195 X |
| 4,273,833 | 6/1981 | De Long | 405/216 X |
| 4,415,293 | 11/1983 | Engel et al. | 405/216 |
| 4,425,054 | 1/1984 | Blondy et al. | 405/211 |
| 4,521,475 | 6/1985 | Riccio et al. | 428/142 |

FOREIGN PATENT DOCUMENTS

| | | |
|---|---|---|
| WO83/03804 | 11/1983 | PCT Int'l Appl. . |
| 881481 | 11/1961 | United Kingdom . |
| 1040093 | 8/1966 | United Kingdom . |
| 1217408 | 12/1970 | United Kingdom . |

OTHER PUBLICATIONS

Bleakley, W. B., "Platform Inspection and Maintenance: An Expensive Necessity", from Petroleum Engineer International, May 1985, pp. 30, 31, 33, 36, and 40.

Engel, R. F. and Ray, J. P., "Bio-Shield: An Anti--Fouling System for Offshore Platforms That Works!" Presented at Oceans '85, Nov. 12-14, 1985, San Diego, CA.

Gaffoglio, C. J., "Copper-Nickel Sheathing Improving Jacket Performance", Offshore Magazine, Nov. 1985.

"Copperlok: Anti-Fouling Systems and Advanced Coatings for Industry", advertising brochure from Copperlok Inc. (undated).

*Primary Examiner*—David H. Corbin
*Assistant Examiner*—John A. Ricci
*Attorney, Agent, or Firm*—Keith A. Bell

[57] ABSTRACT

A method for constructing inspectable welded joints which are resistant to marine biofouling, and the welded joints formed thereby, are disclosed. The method comprises bonding a first coating of a substantially dielectric material to the welded joint and bonding a second coating of a marine growth-inhibiting material to the first coating. The first coating preferably is less ductile than the underlying welded joint. The second coating is electrically insulated from the underlying welded joint by the first coating and provides a source of a biocide which prevents the accumulation of marine biofouling encrustations. Fatigue cracks occurring in the welded joint propagate through the coatings and are readily visible on the outer surface of the second coating. Further, fatigue cracks in the welding joint may be detectable through the use of nondestructive testing techniques prior to the time when they are visible on the outer surface.

14 Claims, 2 Drawing Sheets

FIG. 3A
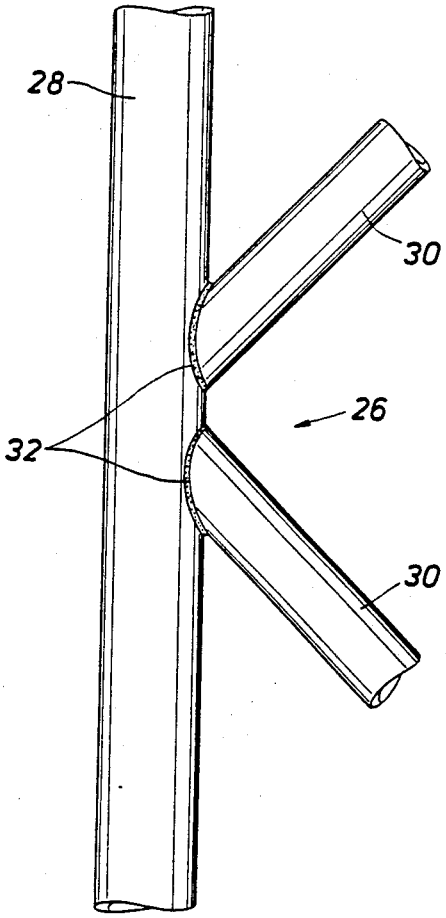
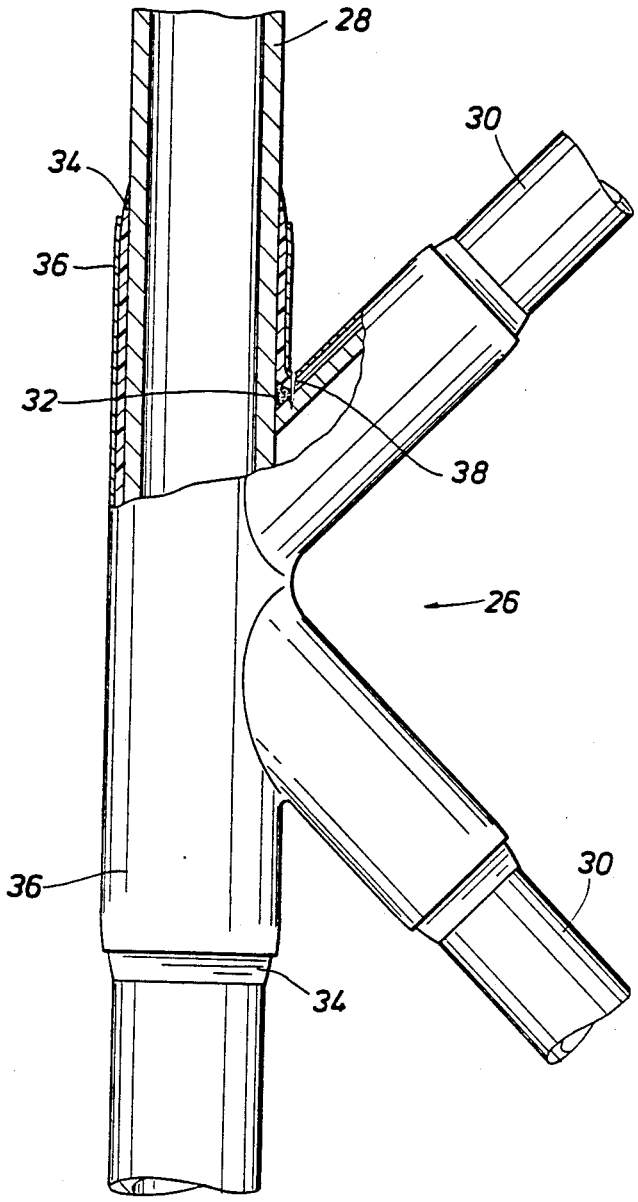
FIG. 3B

METHOD FOR CONSTRUCTING INSPECTABLE WELDED JOINTS WHICH ARE RESISTANT TO MARINE BIOFOULING, AND WELDED JOINTS FORMED THEREBY

FIELD OF THE INVENTION

This invention relates generally to the field of offshore structures. More particularly, but not by way of limitation, the invention pertains to a method for constructing inspectable welded joints which are resistant to marine biofouling for use in an offshore structure, and to the welded joints formed thereby.

BACKGROUND OF THE INVENTION

Offshore petroleum drilling and producing operations commonly are conducted from bottom-founded offshore structures which typically are constructed by welding large diameter steel tubular members together to form a trussed framework known as a "steel jacket structure". Such steel jacket structures may be of either the fixed type, which rigidly resist environmental forces resulting from wind, waves, and currents or the compliant type which yield to the environmental forces in a controlled manner; and either type may be as much as 1,000 feet (305 meters) or more in height.

Steel jacket structures are subject to damage from a variety of causes. For example, a steel jacket structure must be capable of withstanding not only the relatively infrequent impacts of very large waves caused by severe storms, but also the cumulative effects of repeated impacts of smaller waves which are present under most sea states. These smaller waves tend to cause vibration in the individual tubular members of the jacket structure. Vibration of a tubular member may result in the formation of fatigue cracks at or near the welded ends of the member which, if undetected and uncorrected, could ultimately result in a fatigue failure.

Another potential cause of damage to a steel jacket structure is corrosion. The corrosion that is of the greatest concern is that which occurs along the weld at one of the jacket structure's primary welded joints. This type of corrosion, known as "knife-edge corrosion", occurs at the juncture of the weld metal and the heat-affected-zone of the base metal. Knife-edge corrosion acts as a stress raiser thereby reducing the welded joint's ability to withstand fatigue loadings.

An offshore petroleum reservoir may have a producing life in excess of 30 years. The offshore structure used to produce such a reservoir must have a useful life which exceeds the anticipated producing life of the reservoir. Since the damage resulting from vibration and corrosion generally occurs over a substantial period of time, it is desirable that the welded joints of an offshore structure be inspected periodically so that damage may be detected and corrective action may be taken before a failure occurs.

In shallow waters, the welded joints of a steel jacket structure typically are inspected visually by a diver. In deeper waters, a manned submersible vessel may be used to facilitate visual inspection of the welded joints, or an unmanned submersible vessel may be equipped with television cameras to permit remote visual inspection of the joints.

As is well known in the art, certain nondestructive testing techniques may be used in addition to or in place of visual inspection to detect the presence of fatigue or corrosion cracks in the welded joints of a steel jacket structure. Such nondestructive testing techniques include, without limitation, electromagnetic, acoustic, magnetic particle, eddy-current, and ultrasonic testing.

In many areas of the world, such as offshore California and offshore Australia, a steel jacket structure is subject to a phenomenon known as "marine biofouling." As used herein and in the claims, "marine biofouling" means an organic encrustation comprising colonies or clusters of barnacles, mussels, hydroids, anemones, and other forms of marine life which forms under certain conditions on materials located in an offshore environment, such as the steel tubular members of a steel jacket structure. This organic encrustation grows in the form of a sheath or coating which may be as much as 24 inches or more thick.

Marine biofouling is harmful to an offshore structure in two different ways. First, the sheath of organic encrustation surrounding a tubular member of a steel jacket structure adds substantially to the weight and effective diameter of the member, thereby substantially increasing the wave and current forces which the steel jacket structure must resist. This is especially true since, as shown in FIG. 1 and more fully described below, marine biofouling tends to occur primarily near the surface of the body of water, which is the area where wave and current forces are generally the highest. Second, marine biofouling substantially obstructs efforts to periodically inspect the welded joints of an offshore structure, either visually or by any of the other available techniques, for the presence of fatigue or corrosion cracks. As noted above, the sheath of organic encrustation surrounding a tubular member may be as much as 24 inches or more thick. None of the presently known techniques for crack detection can be reliably used to inspect a heavily encrusted joint.

U. S. Pat. No. 4,415,293 issued Nov. 15, 1983 to Engel et al. discloses an effective solution to the first problem described above (i.e., marine biofouling resulting in a substantial increase in the wave and current forces which the steel jacket structure must resist). The Engel et al. patent discloses a method of preventing marine biofouling on the tubular members of a steel jacket structure by covering the tubular members with a sheath of marine growth-inhibiting material. The sheath comprises an outer layer of a non-ferrous material such as a copper-nickel alloy and an inner layer of an elastomeric polymeric material. The outer layer of non-ferrous material provides a source of a biocide or marine growth-inhibiting agent which substantially eliminates the attachment of marine biofouling encrustations.

The Engel et al., patent, however, does not offer an acceptable solution to the second problem discussed above (i.e., marine biofouling substantially obstructing inspection of the welded joints of the steel jacket structure). This is because application to a welded joint of a sheath of marine growth-inhibiting material in the manner taught by Engel et al. would itself obstruct inspection of the welded joint. Fatigue cracks in the underlying welded joint could not propagate through the ductile inner layer taught by Engel et al. and, therefore, could not be visually detected. Further, the ductile inner layer of Engel et al. would substantially negate the reliability of most commonly used underwater nondestructive testing methods for detecting cracks in the underlying welded joint.

Accordingly, a need exists for a method for substantially preventing marine biofouling of the welded joints in a steel jacket structure without obstructing the periodic inspection of such welded joints.

SUMMARY OF THE INVENTION

The present invention is a method for substantially preventing the accumulation of marine biofouling encrustations on a welded joint in an offshore structure without substantially obstructing the inspectability of the welded joint. The invention also includes the inspectable welded joint construction resulting from application of the method.

The method comprises bonding first and second coatings to the welded joint. The first coating comprises a substantially dielectric material which, preferably, has a ductility less than or equal to the ductility of the welded joint. Typically, the first coating would be sprayed or painted onto the welded joint. Suitable materials for the first coating include ceramics and certain thermosetting plastics. The second coating comprises a marine growth-inhibiting material which is bonded to the first coating. The preferred material is a copper-nickel alloy containing at least 70% copper. However, other nonferrous materials may also possess the requisite marine growth-inhibiting properties. The second coating must be electrically insulated from the underlying welded joint by the first coating. The second coating may be applied in any suitable manner, such as by metal spraying or electrochemical plating.

The marine growth-inhibiting material provides a source of a biocide which substantially prevents the accumulation of marine biofouling encrustations on the welded joints. This permits periodic inspection of the welded joints without the necessity for cleaning the welded joints prior to the inspection. Fatigue cracks occurring in the welded joint propagate through the first and second coatings and are readily visible on the outer surface of the second coating. Such cracks may also be detected by commonly used nondestructive testing techniques, even before the cracks have propagated through the coatings.

BRIEF DESCRIPTION OF THE DRAWINGS

The advantages of the present invention will be better understood by referring to the following detailed description and the attached drawings in which:

FIG. 3A illustrates a "K-connection" of the type commonly used in a steel jacket structure; and FIG. 3B illustrates, in partial section, the present invention as applied to the K-connection illustrated in FIG. 3A.

While the invention will be described in connection with its preferred embodiments, it will be understood that the invention is not limited thereto. On the contrary, it is intended to cover all alternatives, modifications, and equivalents which may be included within the spirit and scope of the invention.

DETAILED DESCRIPTION OF THE PREFERRED EMBODIMENTS

Figure 1:
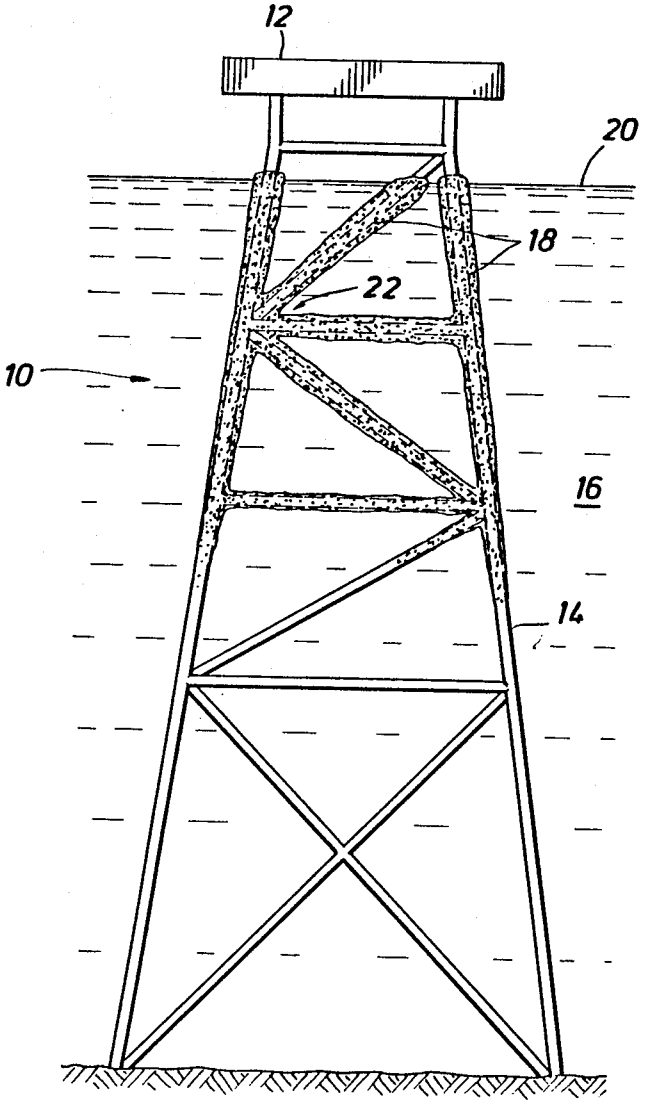
FIG. 1 illustrates the problem of marine biofouling of a steel jacket structure.

FIG. 1 illustrates the problem of marine biofouling. An offshore structure 10 comprising a deck 12 supported by a steel jacket structure 14 is located in a body of water 16. Over a period of time, a sheath of organic encrustation 18 accumulates or grows on certain of the tubular members of steel jacket structure 14. Generally, the sheath of organic encrustation 18 is thickest (up to 24 inches or more) near the surface 20 of body of water 16. Below a depth of about 100 feet, marine biofouling is not a significant problem due to the lack of nutrients and sunlight in deep waters.

The sheath of organic encrustation 18 substantially increases the effective diameter and weight of the individual members of the steel jacket structure, thereby substantially increasing the wave and current forces which the structure must resist. Additionally, the sheath of organic encrustation 18 substantially obstructs inspection of the welded joints (e.g., the welded joints in T-K connection 22) of steel jacket structure 14.

As noted above, the organic encrustation comprises colonies or clusters of barnacles, mussels, hydroids, anemones, and other forms of marine life. Typically, this organic encrustation is very firmly adhered to the individual members of the steel jacket structure and can only be removed by wire brushing or waterblasting, both of which are very time consuming and expensive operations. Accordingly, it is highly desirable that an effective method for preventing marine biofouling be developed.

Figure 2:
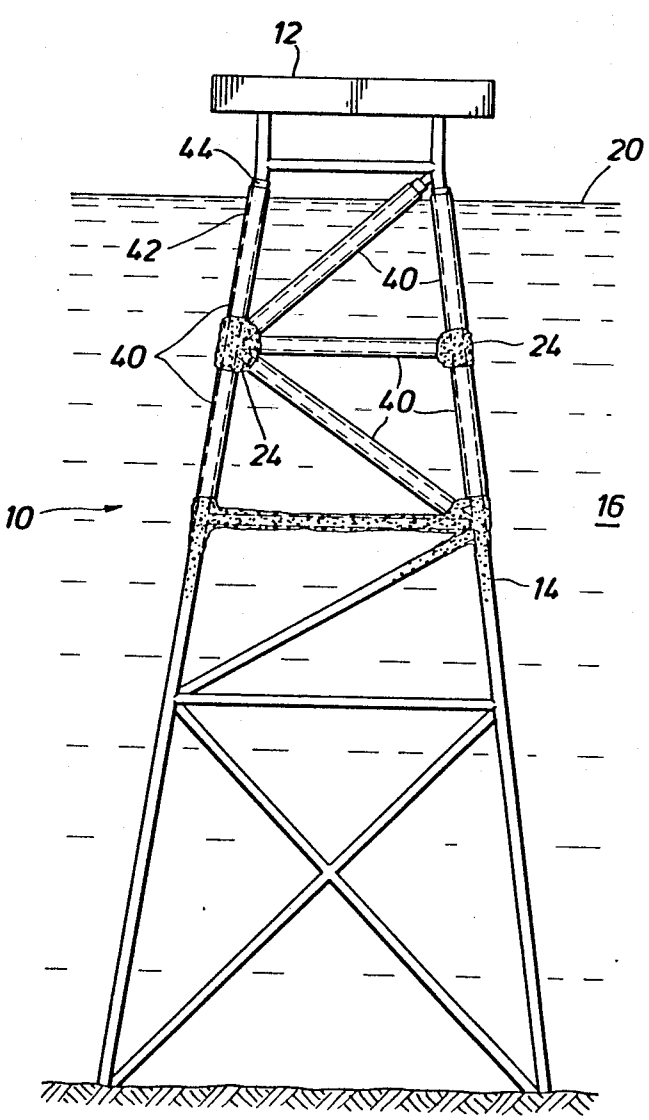
FIG.2 (PRIOR ART)
FIG. 2 illustrates the application of a sheath of marine growth-inhibiting material to the straight portions of the tubular members of a steel jacket structure and the attendant marine biofouling of the unsheathed welded joints.

FIG. 2 illustrates use of the method for preventing marine biofouling disclosed in the Engel et al. patent, discussed above. The Engel et al. patent teaches the use of a protective sheath 40 surrounding at least those members of the steel jacket structure which are subject to the heaviest accumulation of marine biofouling. The sheath 40 comprises an outer layer 42 of a marine growth-inhibiting material and an inner layer 44 of a ductile, electrically non-conductive material. Engel et al. describes the construction and functioning of protective sheath 40 as follows:

"The sheath 40 . . . is illustrated as a thin-walled sheet of a non-ferrous material arranged along the leg [of the jacket structure] and fixedly positioned adjacent thereto in a spaced-apart relationship. . . . In the worst marine growth areas, the sheath may extend from about 3 feet above the mean low tide water level to about 50 or 60 feet below. . . . The sheath 40 includes a substance for generating in sea water a source of marine growth-inhibiting agent in an amount sufficient, when positioned in sea water, to eliminate substantially most if not all the marine growth and to prevent its attachment to the outer surface of the sheath and to that portion of the structural member adjacent to the sheath.

"The thin-walled sheath of non-ferrous material forming the sheath may be copper but the low strength characteristics and poor handling qualities of this material for offshore installations places it low on the list of materials to work with. A copper-nickel alloy with about at least 70% copper in it is suitable, while an alloy having about 90% copper and 10% nickel in it is preferred.

"The action by which the sheath prevents marine growth is not entirely understood but it is believed that the copper ions in a predominantly copper alloy sheath generate in the sea water a cuprous hydroxychloride compound coating on the copper alloy sheath which inhibits the attachment of free-swimming marine larvae. It was found that the above marine growth preventing characteristics of the copper disappeared when the copper alloy sheath 40 was directly mounted on a steel structural member of the platform which was provided with a cathodic protection system in the form of [sacrificial anodes directly attached to the various tubular members of the jacket structure] . . . . Thus, it was found necessary to electrically insulate the sheath 40 from the leg [of the jacket structure]. This is most easily done by filing the space between the sheath 40 and the smaller-diameter leg [of the jacket structure] with a non-conductive material of any suitable type. This could be done most easily by wrapping portions of the legs with rubber, synthetic rubber, or any suitable elastomeric polymeric material which could be bonded, vulcanized or polymerized to the outer surface of the legs either by the application of a bonding material or heat or both, or with heat and pressure . . . . " Engel et al., column 6, line 25 to column 7, line 7.

As described above, the Engel et al. patent discloses an effective method for preventing marine biofouling along the straight portions of the steel jacket structure's tubular members. However, as illustrated in FIG. 2, the protective sheaths 40 disclosed by Engel et al. do not cover the welded joints between the various tubular members, thereby allowing localized clumps of organic encrustation 24 to accumulate or grow at the welded joints. These clumps of organic encrustation 24 substantially obstruct inspection of the welded joints and, accordingly, must be periodically removed by wire brushing or waterblasting to permit inspection. Moreover, the method of preventing marine biofouling disclosed in the Engel et al. patent cannot be applied to the welded joints of a steel jacket structure since the protective sheaths 40 would themselves obstruct both visual inspection and nondestructive testing of the welded joints. Moreover, at best it would be extremely difficult to shape the protective sheaths 40 disclosed by Engel et al. to fit the welded joints in an offshore structure. Any leakage of sea water under the sheath could result in corrosion at a place where it would be extremely difficult to detect.

The present invention is a novel welded joint construction which is resistant to marine biofouling and which can be easily inspected, either visually or through the use of conventional nondestructive inspection techniques. The term "welded joint" as used herein and in the claims means any joint in which two or more metal members are joined by welding (the localized coalescence of metal produced by heating), either with or without the application of pressure, and either with or without the use of an intermediate or filler metal. A welded joint will be deemed to include a portion of the base metal on either side of the weld, such portion comprising at least the "heat-affected-zone" (i.e., that part of the base metal in which one or more of the metallurgical properties of the base metal was changed as a result of the heating).

It will be understood that although the invention will be described in connection with a welded joint for use in a steel jacket structure, the invention may also be used for other types of welded joints located in environments subject to marine biofouling. Accordingly, all such uses are intended to be included within the scope of the invention.

FIG. 3A illustrates a typical K-connection 26 such as might be used in a steel jacket structure. K-connection 26 comprises a primary tubular member 28 and two angled secondary tubular members 30. The secondary tubular members 30 are attached to primary tubular member 28 by circumferential welds 32. Thus, a K-connection may be deemed to include two welded joints, as that term is defined above. Other standard types of connections used in offshore structures may include only one welded joint (i.e., T and Y connections) or as many as three or more welded joints (i.e., T-K connection 22 in FIG. 1).

FIG. 3B illustrates the present invention. For purposes of illustration, the invention has been applied to K-connection 26 described above. However, it will be understood that the invention is equally applicable to any other type of connection which includes one or more welded joints.

Basically, the invention comprises a first coating 34 of a substantially dielectric material which is bonded to the underlying welded joint and a second coating 36 of a marine growth-inhibiting material which is bonded to first coating 34. Second coating 36 is electrically insulated from the welded joint by first coating 34. As will be more fully described below, fatigue cracks (e.g., crack 38) in the welded joints of K-connection 26 propagate through both the first coating 34 and the second coating 36 and are readily visible on the surface of the joint. Further, such fatigue cracks may be detectable through the first and second coatings by the use of nondestructive testing techniques, such as ultrasonic testing, prior to the time when they can be detected visually.

Fatigue cracks in a welded joint typically occur in the weld itself, at the juncture between the weld and the heat-affected-zone, or in the heat-affected-zone. Generally, the heat-affected-zone extends no more than a few inches on either side of the weld. Thus, first coating 34 and second coating 36 need extend only a short distance (e.g., 6 to 12 inches) on either side of circumferential weld 32. Beyond that distance the protective sheaths taught by Engel et al. (see FIG. 2) may be used to prevent marine biofouling since it is unlikely that fatigue cracks will occur more than a few inches from the weld itself. For this reason inspection programs nearly always focus on the weld itself and the immediately surrounding area.

First coating 34 must be bonded to the underlying welded joint so that fatigue cracks occurring in the welded joint will propagate through first coating 34. In the absence of a bond, relative movement or slippage between first coating 34 and the welded joint would substantially retard crack propagation through first coating 34. Such relative movement or slippage could also cause erroneous results during nondestructive testing of the welded joint. Any type of bond (e.g., chemical, mechanical, metallurgical, etc.) may be used. Typically, first coating 34 would be applied in a liquid form (e.g., by spraying or painting) and then allowed to cure in place to ensure a good bond. First coating 34 may be applied in more than one layer if desired.

The material used for first coating 34 must have a sufficiently low ductility (as measured by the percent elongation at fracture) to permit fatigue crack propagation. Thus, it is highly preferable that the ductility of the substantially dielectric material be less than or equal to the ductility of the welded joint. If the ductility of the substantially dielectric material is significantly greater than the ductility of the welded joint, crack propagation will be retarded. The ductility of structural steel is generally between about 20% and about 30%. Thus, the ductility of the substantially dielectric material should preferably be less than or equal to about 20%.

As will be more fully explained below, the material used for first coating 34 must also be capable of electrically insulating second coating 36 from the welded joint. In order to ensure proper insulation of second coating 36, first coating 34 should preferably have a thickness of at least 10 mils (250 microns), although greater thicknesses may be used if desired.

A number of materials are available which satisfy the above described requirements for first coating 34 (i.e., a substantially dielectric material which has a low ductility and which can be bonded to the underlying welded joint). Examples of suitable materials are ceramics and certain thermosetting plastics such as phenolic resins, epoxy resins, and polyester resins.

Second coating 36 must be capable of inhibiting the growth of marine biofouling encrustations. As set forth in the excerpt from the Engel et al. patent reproduced above, it has been found that a copper-nickel alloy containing at least 70% copper is suitable, while a copper-nickel alloy containing 90% copper and 10% nickel is preferred. Other non-ferrous materials may also be capable of inhibiting marine growth.

Second coating 36 must be bonded to first coating 34 so that fatigue cracks in the underlying welded joint (e.g., crack 38) will propagate through to the outer surface of second coating 36. Any type of bond may be used. One suitable method of applying second coating 36 is by thermal spraying in which the copper-nickel alloy, in powder or wire form, is melted in an electric or oxyacetylene arc and the molten particles are propelled at high speed against the desired substrate by compressed air. One type of thermal spraying is described in U.S. Pat. No. 4,521,475 issued June 4, 1985 to Riccio et al. In Riccio et al. a specially prepared substrate containing hollow spheres or voids is used to ensure a strong mechanical bond between the coating and the substrate. Use of the substrate disclosed by Riccio, while not a necessary element of the present invention, may be desirable, especially for offshore structures having a relatively long anticipated life. Other methods for applying second coating 36, such as by electrochemical plating, may also be used. Second coating 36 may be applied in one or more layers.

As noted above, second coating 36 must be electrically insulated from the underlying base metal in order for it to inhibit marine biofouling. Therefore, as illustrated in FIG. 3B, second coating 36 should end a short distance before the end of first coating 34. Typically, second coating 36 would be approximately 10 mils (250 microns) thick, although thicker coatings may be desired, especially for structures having long anticipated lifetimes.

In practicing the present invention, the first and second coatings would typically be applied to the welded joints in the construction yard during fabrication of the steel jacket structure. Generally, only the welded joints which will be located within 100 feet of the surface of the body of water would be coated. The jacket structure would then be transported to the installation site and affixed to the floor of the body of water. Periodically during the lifetime of the jacket structure, the welded joints should be inspected for the presence of fatigue cracks, such as crack 38 in FIG. 3B. Welded joints which have been constructed according to the present invention will remain substantially free from marine biofouling encrustations and, accordingly, may be easily inspected, either visually or through the use of nondestructive testing techniques, without the necessity for wire brushing or waterblasting. In fact, experiments have shown that the present invention may actually enhance the visibility of fatigue cracks in a welded joint. Further, experimentation has shown that fatigue cracks in the underlying welded joint can readily be detected through the first and second coatings by conventional nondestructive testing techniques, (e.g., ultrasonic testing) even before they have propagated through to the outer surface of second coating 36.

As described above, the present invention satisfies the need for a method for substantially preventing marine biofouling of welded joints in an offshore structure without obstructing the periodic inspection of such welded joints. It should be understood that the invention is not to be unduly limited to the foregoing which has been set forth for illustrative purposes. Various modifications and alterations of the invention will be apparent to those skilled in the art without departing from the true scope of the invention, as defined in the following claims.

I claim:

1. A method for substantially preventing the accumulation of marine biofouling encrustations on a welded joint in an offshore structure without substantially obstructing the inspectibility of said welded joint, said method comprising the steps of:

bonding a first coating of a substantially dielectric material to said welded joint, said substantially dielectric material having a ductility less than or equal to the ductility of said welded joint;

bonding a second coating of a marine growth-inhibiting material to said first coating, said second coating being electrically insulated from said welded joint by said first coating;

whereby marine biofouling encrustations are substantially prevented from adhering to said welded joint by said second coating and fatigue cracks occurring in said welded joint beneath said first and second coatings may be detected by commonly used underwater inspection procedures.

2. The method of claim 1 wherein said substantially dielectric material is a ceramic.

3. The method of claim 1 wherein said substantially dielectric material is a thermosetting plastic.

4. The method of claim 1 wherein said marine growth-inhibiting material is a copper-nickel alloy containing at least 70% copper.

5. In an offshore structure, an inspectable welded joint construction which is resistant to the accumulation of marine biofouling encrustations, said welded joint construction comprising:

a welded joint;

a first coating of a substantially dielectric material bonded to said welded joint, said substantially dielectric material having a ductility equal to or less than the ductility of said welded joint;

a second coating of a marine growth-inhibiting material bonded to said first coating, said second coating being electrically insulated from said welded joint by said first coating;

whereby marine biofouling encrustations are substantially prevented from adhering to said welded joint construction by said second coating and fatigue cracks occurring in said welded joint beneath said first and second coatings may be detected by commonly used underwater inspection procedures.

6. The welded joint construction of claim 5 wherein said substantially dielectric material is a ceramic material.

7. The welded joint construction of claim 5 wherein said substantially dielectric material is a thermosetting plastic.

8. The welded joint construction of claim 5 wherein said first coating has a thickness of at least 0.010 inches.

9. The welded joint construction of claim 5 wherein said marine growth-inhibiting material is a copper-nickel alloy containing at least 70% copper.

10. A method for detecting fatigue cracks in a welded joint of an offshore structure which is subject to marine biofouling encrustations, said method comprising the steps of:

bonding a first coating of a substantially dielectric material to said welded joint, said substantially dielectric material having a ductility less than or equal to the ductility of said welded joint;

bonding a second coating of a marine growth-inhibiting material to said first coating, said second coating being electrically insulated from said welded joint by said first coating, whereby marine biofouling encrustations are substantially prevented from adhering to said welded joint and fatigue cracks occurring in said welded joint beneath said first and second coatings may be detected by commonly used underwater inspection procedures; and conducting periodic inspections of said welded joint to detect the presence of fatigue cracks.

11. The method of claim 10 wherein said inspections are performed by using ultrasonic testing techniques.

12. A method for detecting fatigue cracks in a welded joint of an offshore structure which is subject to marine biofouling encrustations, said method comprising the steps of:

bonding a first coating of a substantially dielectric material to said welded joint, said substantially dielectric material having a ductility less than or equal to the ductility of said welded joint;

bonding a second coating of a marine growth-inhibiting material to said first coating, said second coating being electrically insulated from said welded joint by said first coating, whereby marine biofouling encrustations are substantially prevented from adhering to said welded joint and fatigue cracks occurring in said welded joint tend to propagate through said first and second coatings and become visually detectable on the surface of said second coating; and conducting periodic visual inspections of said welded joint.

13. The method of claim 12 wherein said visual inspections are conducted by a diver.

14. The method of claim 12 wherein said visual inspections are conducted remotely via an underwater television camera.

* * * * *